US007241025B2

(12) United States Patent
Kim

(10) Patent No.: US 7,241,025 B2
(45) Date of Patent: Jul. 10, 2007

(54) SWITCH ACTUATED FLASHLIGHT WITH CURRENT LIMITER

(75) Inventor: Paul Y. Kim, Santa Ana, CA (US)

(73) Assignee: Surefire, LLC, Fountain Valley, CA (US)

( * ) Notice: Subject to any disclaimer, the term of this patent is extended or adjusted under 35 U.S.C. 154(b) by 153 days.

(21) Appl. No.: 11/042,002

(22) Filed: Jan. 24, 2005

(65) Prior Publication Data

US 2006/0164828 A1 Jul. 27, 2006

(51) Int. Cl.
*F21L 4/04* (2006.01)
*F21L 4/00* (2006.01)

(52) U.S. Cl. ..... 362/205; 362/208

(58) Field of Classification Search ..... 362/202, 362/205, 208; 200/60
See application file for complete search history.

(56) References Cited

U.S. PATENT DOCUMENTS 2,020,352 A 11/1935 Bolduc
2,769,896 A 11/1956 Lambert
2,852,632 A 9/1958 Garland
2,852,633 A 9/1958 Garland
4,581,686 A 4/1986 Nelson
4,782,432 A * 11/1988 Coffman ..... 362/184
5,345,370 A 9/1994 Murray et al.
6,086,218 A * 7/2000 Robertson ..... 362/157

OTHER PUBLICATIONS

Page 97 of "SUREFIRE 2002 Illumination Tools" catalog, published by SUREFIRE, LLC, Fountain Valley, California (prior to Dec. 2002).

* cited by examiner

*Primary Examiner*—Ali Alavi

(57) ABSTRACT

A searchlight or flashlight including a lamp portion having multiple operative states (for example, ON, OFF, HIGH, and LOW), and an easily-operated actuator ring encircling the light and engaging at least two spaced-apart, redundant switches that are mounted on the light. A user rotates the ring to operate the switches. The tail cap of the light includes a replaceably removable fuse or circuit breaker.

64 Claims, 8 Drawing Sheets

SWITCH ACTUATED FLASHLIGHT WITH CURRENT LIMITER

BACKGROUND OF THE INVENTION

1. Field of the Invention

The present invention relates to flashlights for use in combat, search and rescue, or inclement weather and, more particularly, to large and/or powerful flashlights, and especially to large, hand-held searchlights.

2. Description of the Related Art

A person using a flashlight or searchlight (which terms are used interchangeably herein) in an emergency or combat situation prefers to know in advance where the on-off switch is, how to reach it, and how to operate it without inspecting it or experimenting with it. Such a person also prefers that the searchlight and its parts, including the switch, perform reliably despite heat, cold, wet, dirt, and abuse. What is needed is a tactically adapted searchlight on-off mechanism based on a rugged, reliable switch.

SUMMARY OF THE INVENTION

It is an object of the present invention to provide a hand-held searchlight having an easily locatable switch actuator.

In accordance with this object and with others which will be described and which will become apparent, an exemplary embodiment of a searchlight in accordance with the present invention includes a searchlight body. A searchlight lamp portion is operatively connected to the body and having a plurality of operative states. At least two switches are disposed on the searchlight and are adjustable among a plurality of switch conditions corresponding to the operative states. At least one switch-engaging actuator is disposed about the searchlight and is displaceable thereabout among a plurality of actuator positions. The actuator positions correspond to the switch conditions, and thus to the operative states of the lamp portion. Operative states may include, for example: off, low, and high; off, red, and white; off, steady, and flashing; off, infrared, and visible.

In another exemplary embodiment of an actuator for a searchlight in accordance with the present invention the actuator includes a race which includes an actuator guide. The actuator guide is fixed relative to the searchlight body and movably confined within the race, thereby holding the actuator onto the searchlight while allowing it to be operated.

In another exemplary embodiment of a searchlight in accordance with the present invention the actuator is disposed about the body. It should be understood that the present invention is not limited to any particular means of joining or interconnecting a lamp portion and a body of a searchlight. The actuator may, therefore, contact, encircle, or partially cover one or both of the lamp portion and the body.

In another exemplary embodiment, the actuator is rotatably disposed on the searchlight.

In another exemplary embodiment, the actuator encircles the searchlight.

In another exemplary embodiment, the actuator has a grip-textured surface.

In another exemplary embodiment, the actuator mechanically engages two or more switches.

Another exemplary embodiment has a cushion between the actuator and a switch.

In another exemplary embodiment, the actuator includes a cushion.

Another exemplary embodiment has a cushion disposed on a switch.

In another exemplary embodiment, each switch has a toggle and the toggles engage the actuator.

In another exemplary embodiment, a boot encases the toggle.

In another exemplary embodiment, at least two of the switches redundantly engage the actuator. This improves the chances of the searchlight functioning as intended even if one switch malfunctions.

In another exemplary embodiment, at least two of the plurality of switches redundantly establish correspondence between the actuator positions and the operative states. This, too, improves the chances of the searchlight functioning as intended even if one switch malfunctions.

In another exemplary embodiment, the actuator encircles the searchlight and is circumferentially rotatable relative to the searchlight. The switches engage the actuator at circumferentially different locations on the actuator. Separating the switches reduces the chance that an event damaging one switch would damage the others.

Another exemplary embodiment has a tail cap operatively disposed on the body, the tail cap including a current limiter. Current limiting means reduces the chance that a short circuit might cause a fire or other harmful incident.

In another exemplary embodiment, the tail cap is replaceably removable from the searchlight body and the current limiter is replaceably removable from the tail cap.

In another exemplary embodiment, the tail cap including a compartment and an openable closure covering the compartment, the current limiter being contained within the compartment. The cover is easily removed to gain access to the current limiter.

In another exemplary embodiment, the current limiter is selected from the set including: a fuse and a circuit breaker.

Also in accordance with the objects of the invention, for a searchlight having a searchlight body, an exemplary embodiment of a searchlight lamp portion is operatively connected to the body and has a plurality of operative states. The lamp portion is electrically coupled to at least two switches disposed on the searchlight. Each switch is adjustable among a plurality of switch conditions corresponding to the operative states. A switch actuator in accordance with the present invention has at least one switch-engaging actuator disposed about the searchlight. The switch actuator is displaceable about the searchlight among a plurality of actuator positions. The actuator positions correspond to the switch conditions. As the actuator is displaced from one actuator position to another, the switch conditions are adjusted, thereby changing the operative state of the lamp portion.

In another exemplary embodiment of a switch actuator in accordance with the present invention, the switch-engaging actuator includes a race, the race includes an actuator guide, and the actuator guide is fixed relative to the searchlight body and movably confined within the race, thereby holding the switch-engaging actuator onto the searchlight while allowing it to be operated.

Also in accordance with the objects of the invention, an exemplary embodiment of a searchlight has a searchlight body including a lamp portion having a plurality of operative states. At least two switches are disposed on the searchlight and being adjustable among a plurality of switch conditions corresponding to the operative states. At least one switch-engaging actuator is disposed about the searchlight and is displaceable thereabout among a plurality of actuator positions, the actuator positions corresponding to the switch conditions. As the actuator is displaced from one actuator position to another, the switch conditions are adjusted, thereby changing the operative state of the lamp portion.

In another exemplary embodiment of a searchlight in accordance with the present invention, the actuator includes a race, the race includes an actuator guide, and the actuator guide is fixed relative to the searchlight body and movably confined within the race, thereby holding the switch-engaging actuator onto the searchlight while allowing it to be operated.

Also in accordance with the objects of the invention, an exemplary embodiment of a portable searchlight body, adapted to be coupled to a lamp portion having a plurality of operative states, has at least two switches disposed on the searchlight body. The switches are adjustable among a plurality of switch conditions, each switch condition corresponding to an operative state of a lamp portion. A switch-engaging actuator ring is disposed about the searchlight body and is displaceable thereabout among a plurality of actuator positions, the actuator positions corresponding to the switch conditions. As the actuator is displaced from one actuator position to another, the switch conditions are adjusted, thereby changing the operative state of the lamp portion.

In another exemplary embodiment of a searchlight in accordance with the present invention the actuator includes a race, the race includes an actuator guide, and the actuator guide is fixed relative to the searchlight body and movably confined within the race, thereby holding the switch-engaging actuator onto the searchlight while allowing it to be operated.

Also in accordance with the objects of the invention, an exemplary embodiment of an actuating mechanism for a searchlight having a plurality of illuminative states has at least two switches disposed on the searchlight, the switches being adjustable among a plurality of switch conditions corresponding to the operative states. At least one switch-engaging actuator ring is disposed about the searchlight and is rotatable thereabout among a plurality of actuator positions corresponding to the switch conditions. As the actuator ring is displaced from one actuator position to another, the switch conditions are adjusted, thereby changing the operative state of the lamp portion.

In another exemplary embodiment of an actuating mechanism in accordance with the present invention, the actuator includes a race, the race includes an actuator guide, and the actuator guide is fixed relative to the searchlight and movably confined within the race, thereby holding the switch-engaging actuator onto the searchlight while allowing it to be operated.

In another exemplary embodiment of an actuating mechanism, the actuator ring has a grip-textured surface.

In another exemplary embodiment, each switch has a plurality of switch positions corresponding to the switch conditions, the actuator ring mechanically engages the at least two switches, and displacement of the actuator ring among the actuator positions displaces the at least two switches among the switch positions.

Another exemplary embodiment has a cushion operatively disposed between the actuator and at least one switch.

In another exemplary embodiment, the actuator has a cushion.

Another exemplary embodiment has a cushion disposed on the switch.

In another exemplary embodiment, the switch has a toggle and the toggle engages the actuator.

Another exemplary embodiment has a boot disposed on the toggle.

In another exemplary embodiment, at least two switches redundantly engage the actuator.

In another exemplary embodiment, at least two switches redundantly establish correspondence between the actuator positions and the operative states.

In another exemplary embodiment, the actuator encircles the searchlight and is circumferentially rotatable relative to the searchlight. A plurality of switches engage the actuator at circumferentially different locations on the actuator.

Another exemplary embodiment has a tail cap operatively disposed on the body. The tail cap includes a current limiter.

In another exemplary embodiment, the tail cap includes a compartment and an openable closure covering the compartment, the current limiter being contained within the compartment.

In another exemplary embodiment, the current limiter is a fuse or a circuit breaker. The circuit breaker may be the self-resetting variety.

Also in accordance with the objects of the invention, an exemplary embodiment of a searchlight includes a body with an operatively connected searchlight lamp portion. A tail cap is disposed on the body and is replaceably removable therefrom. The tail cap contains a fuse block. A current limiter is disposed in the fuse block and is electrically connectable to limit current delivered to the lamp portion. The current limiter is also replaceably removable from the fuse block.

BRIEF DESCRIPTION OF THE DRAWINGS

For a further understanding of the objects and advantages of the present invention, reference should be had to the following detailed description, taken in conjunction with the accompanying drawing, in which like parts are given like reference numbers and wherein.

DESCRIPTION OF THE PREFERRED EMBODIMENTS

Figure 1:
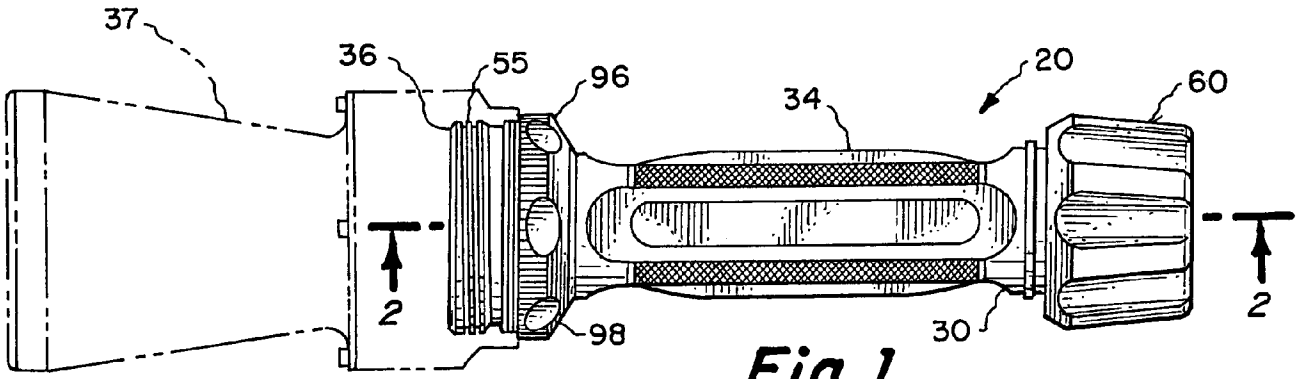
FIG. 1 is a side view of a searchlight or flashlight with a switch actuator in accordance with the present invention.

The invention will now be described with reference to FIGS. 1 and 2, which illustrate a preferred embodiment of a searchlight or flashlight 20 with a switch actuator in accordance with the present invention, comprising generally a metal alloy searchlight body 30 which has an open, cylindrical, externally threaded rear end 32, an elongated, hollow, battery-housing middle portion 34 containing a battery or battery module 35, and an open, cylindrical, externally threaded front end 36. It will be understood that the front end 36 accommodates a plurality of interchangeable lamp portions 37 (shown generally in FIG. 1).

Figure 2:
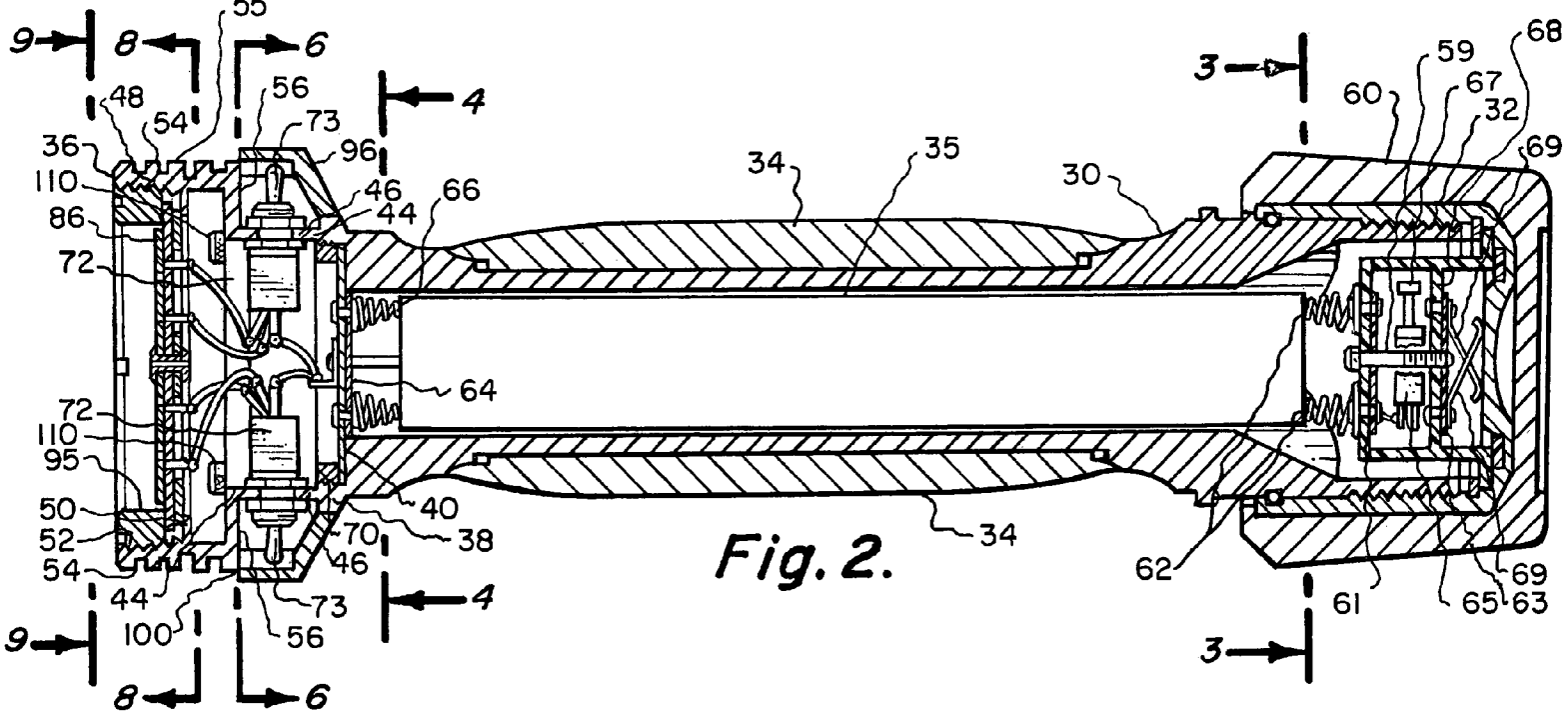
FIG. 2 is a side sectional view of the searchlight body of FIG. 1 taken along line 2-2 in the direction of the appended arrows.
Figure 3:
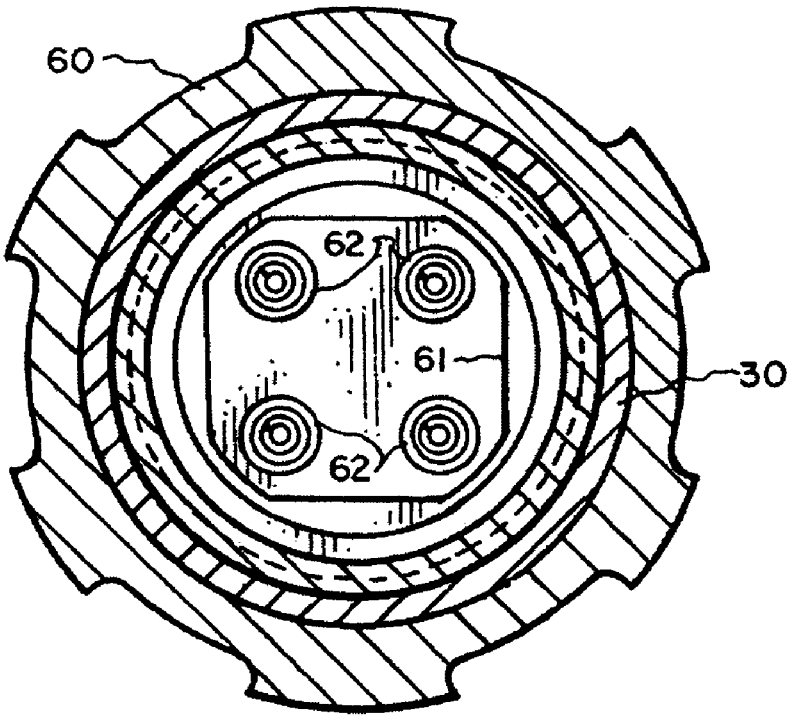
FIG. 3 is a front sectional view of the body of FIG. 2 taken along line 3-3 of FIG. 2 in the direction of the appended arrows.
Figure 5:
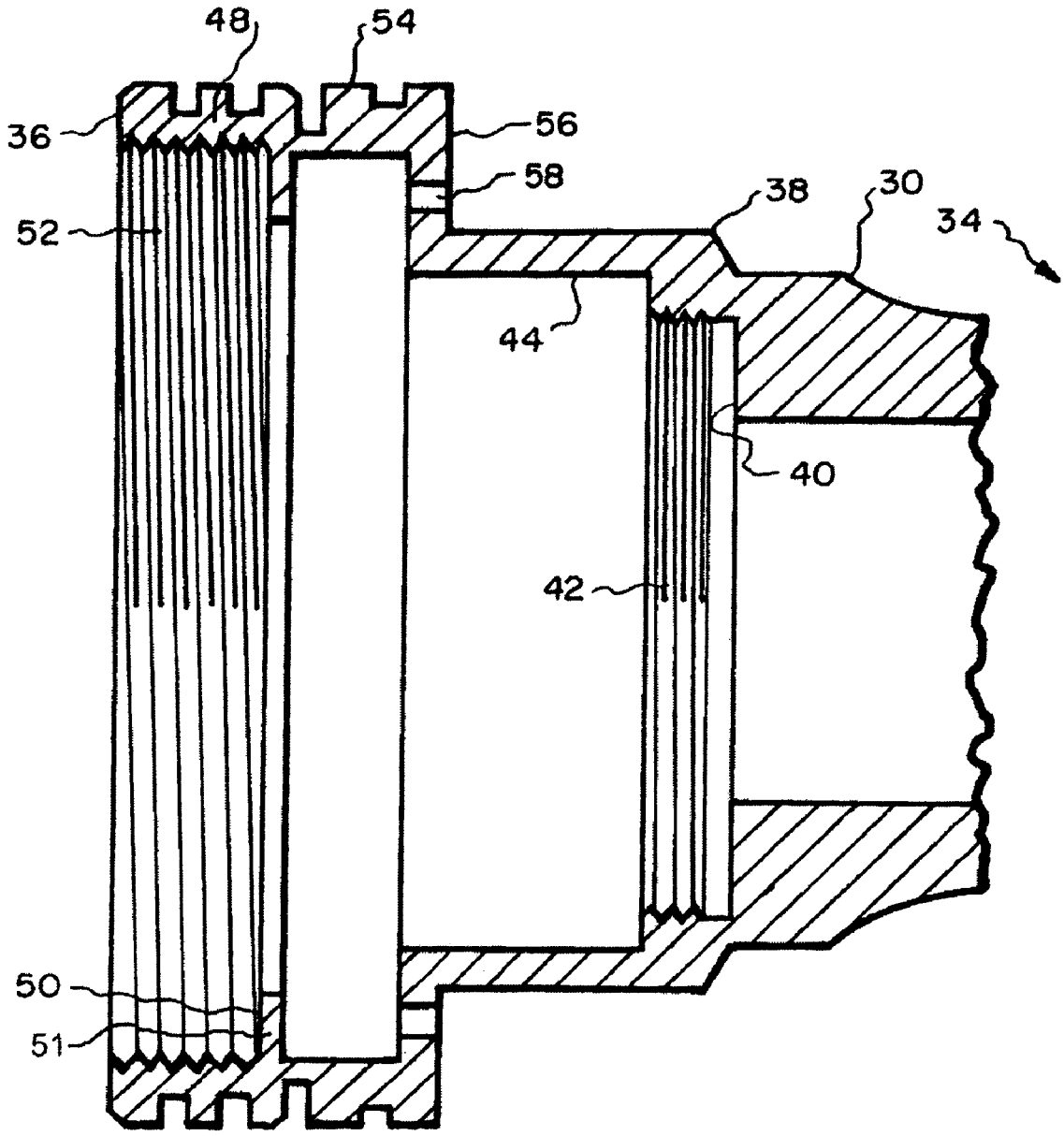
FIG. 5 is a side sectional view of a front end of a searchlight body shell.

With reference to FIGS. 2 and 5, the searchlight body 30 is formed of electrically conductive material such as aircraft aluminum alloy and has a short, cylindrical PC board housing portion 38 forward of the middle portion 34 and rearward of the front end 36. The PC board housing portion 38 includes a forward-facing circular PC board seating surface 40 and, immediately forward thereof, internal PC board retainer engaging threads 42, best seen in FIG. 5.

Figure 6:
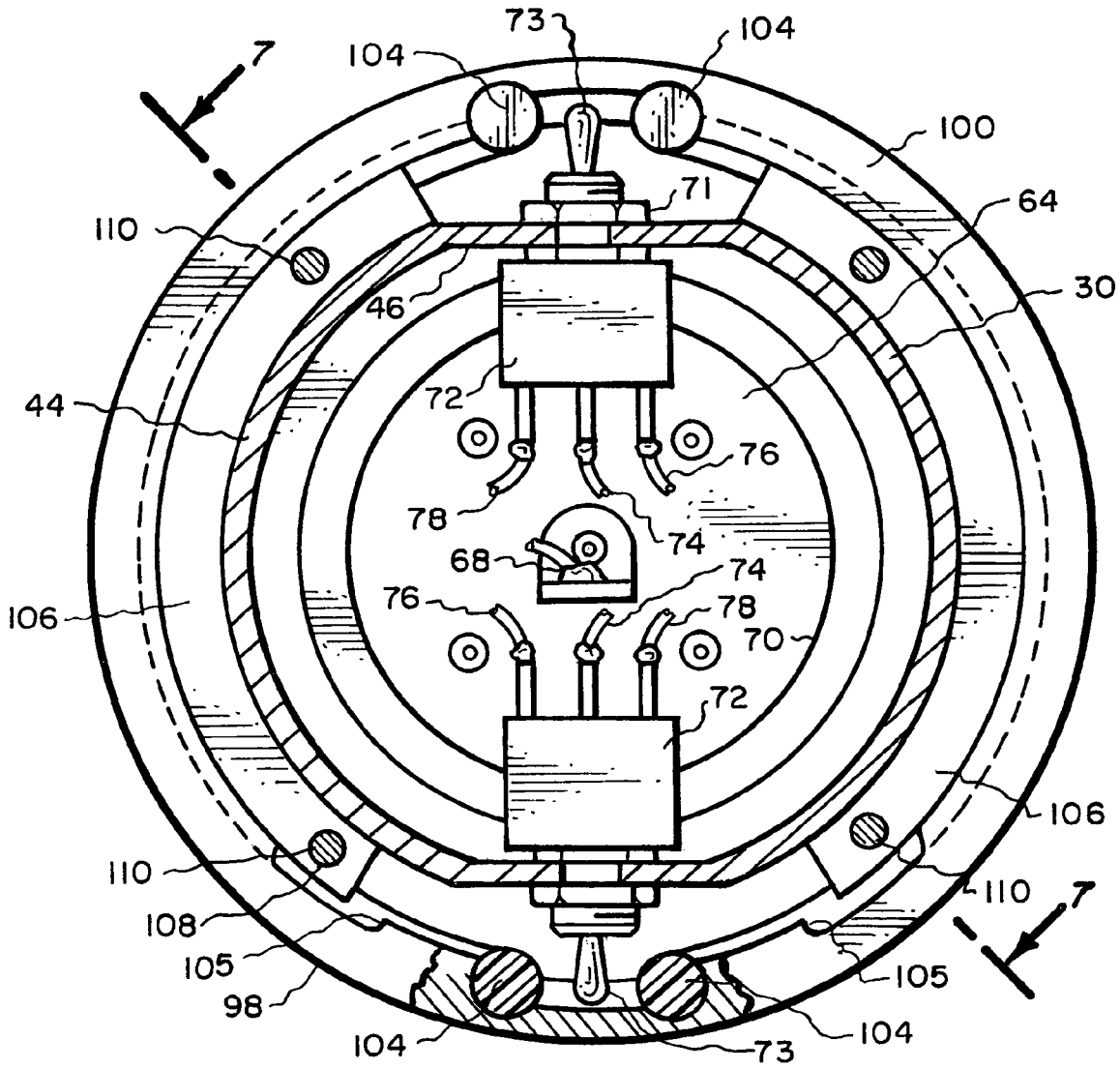
FIG. 6 is a front sectional view of the searchlight body of FIG. 2 taken along line 6-6 in the direction of the appended arrows.

With reference to FIGS. 2, 5, and 6, the searchlight body 30 forms a short switch housing portion 44 forward of the PC board retainer engaging threads 42 and rearward of the front end 36. The switch housing portion 44 forms two diametrically opposite, flattened, perforated switch mounting portions 46, best seen in FIGS. 2 and 6.

With continued reference to FIGS. 2, 5, and 6, the searchlight body 30 has a short, cylindrical mounting board housing portion 48 forward of the switch housing portion 44 and rearward of the front end 36. The mounting board housing portion 48 includes a forward-facing, circular, bare metal mounting board seating portion 51 which presents a forward-facing mounting board seating surface 50. Immediately forward thereof, the mounting board housing portion 48 has internal mounting board retainer engaging threads 52. The mounting board housing portion 48 has a mounting board housing portion outer surface 54 of diameter greater than that of the middle portion 34 of the searchlight body 30 and, thereon, a rearward-facing circular actuator guide seating surface 56. Four actuator guide retainer bores 58 are formed longitudinally through the mounting board housing portion 48 from the mounting board seating surface 50 to the actuator guide seating surface 56. Two of the actuator guide retainer bores 58 are best seen in FIG. 5.

With reference to FIGS. 1, 2, 3, and 11, an internally threaded metal tail cap 60 is provided for engaging the rear end 32 of the searchlight body 30. The tail cap 60 includes a rigid, electrically insulating spring mount plate 61 on which are mounted several forward-biased, forward-protruding metal tail cap springs 62. The tail cap 60 also includes a rigid, electrically insulating current limiter mount plate 63. A current limiter block 65 containing a current limiter 67 is located forward of the current limiter mount plate 63. A rearward-projecting current limiter contact 69 is formed of conductive material which is disposed on the rearward-facing surface of the current limiter mount plate 63.

A screw 59 is shown holding the spring mount plate 61 in place and being screwed into the current limiter mount plate 63. The tail cap springs 62 electrically contact the rear terminal of the battery module 35 and is electrically connected to the current limiter block 65, which provides electrical connection of the current limiter 67 in series between the tail cap springs 62 and the current limiter contact 69, which is biased to press against the tail cap 60. Thus, electrical continuity is safely established between a terminal of the battery module 35 and the searchlight body 30 via the tail cap 60 when the tail cap 60 is threaded onto the rear end 32 of the searchlight body 30. The searchlight body 30 forms part of an electrical ground path for the electric circuit of the searchlight.

Figure 11:
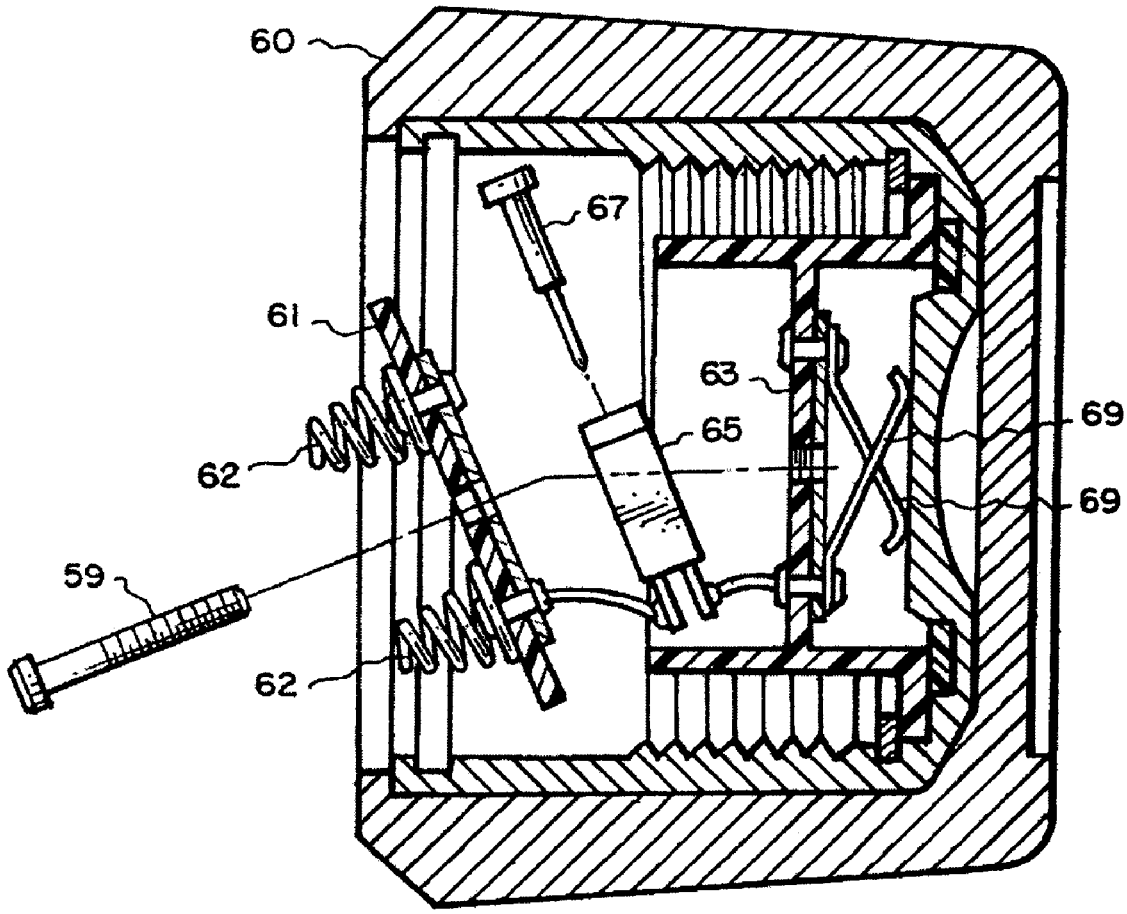
FIG. 11 is a partly exploded side sectional view of the tail cap portion of FIG. 2.

With reference to FIGS. 2 and 11, the current limiter 67 may be a fuse, preferably of an automatic or resetting type, or a manual or preferably automatic resetting circuit breaker.

FIG. 11, a side sectional view of the tail cap 60, shows in greater detail the spring mount plate 61, tail cap springs 62, current limiter mount plate 63, current limiter block 65, current limiter 67, and current limiter contact 69. If it is desired to replace the current limiter 67, the tail cap 60 is unscrewed from the searchlight body 30. The screw 59 is loosened, and the spring mount plate 61 is drawn forward, whereupon the current limiter block 65 may also be drawn forward, giving access to the current limiter 67, which may be withdrawn and replaced. Thus, the present invention provides for ease of replacing or upgrading the current limiter 67.

Figure 4:
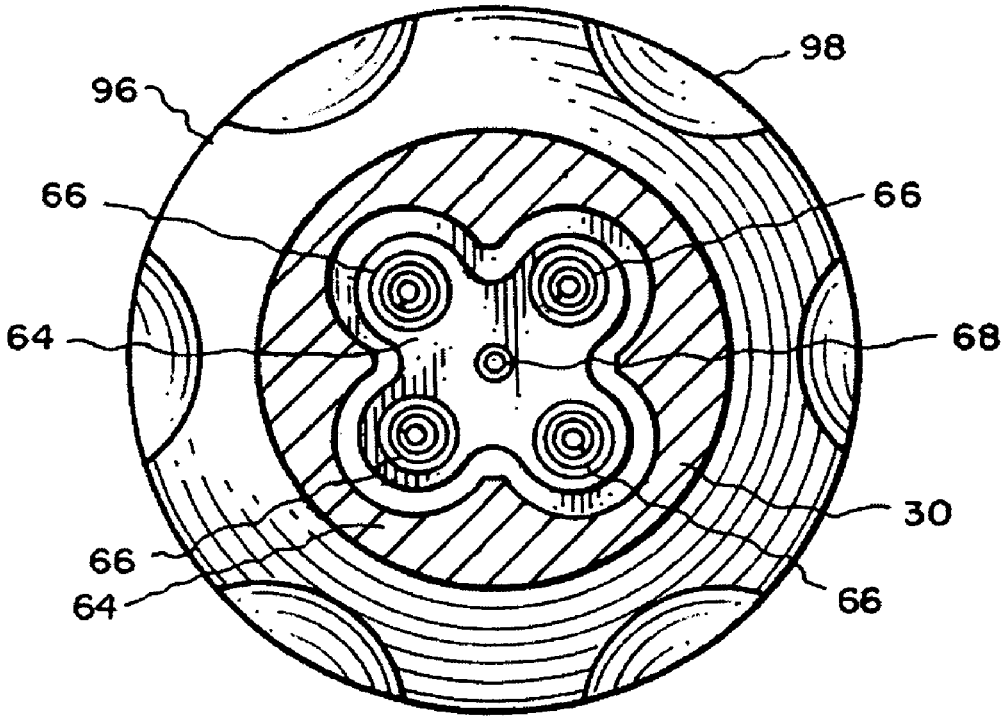
FIG. 4 is a rear sectional view of the body taken along the line 4-4 of FIG. 2 in the direction of the appended arrows.
Figure 7:
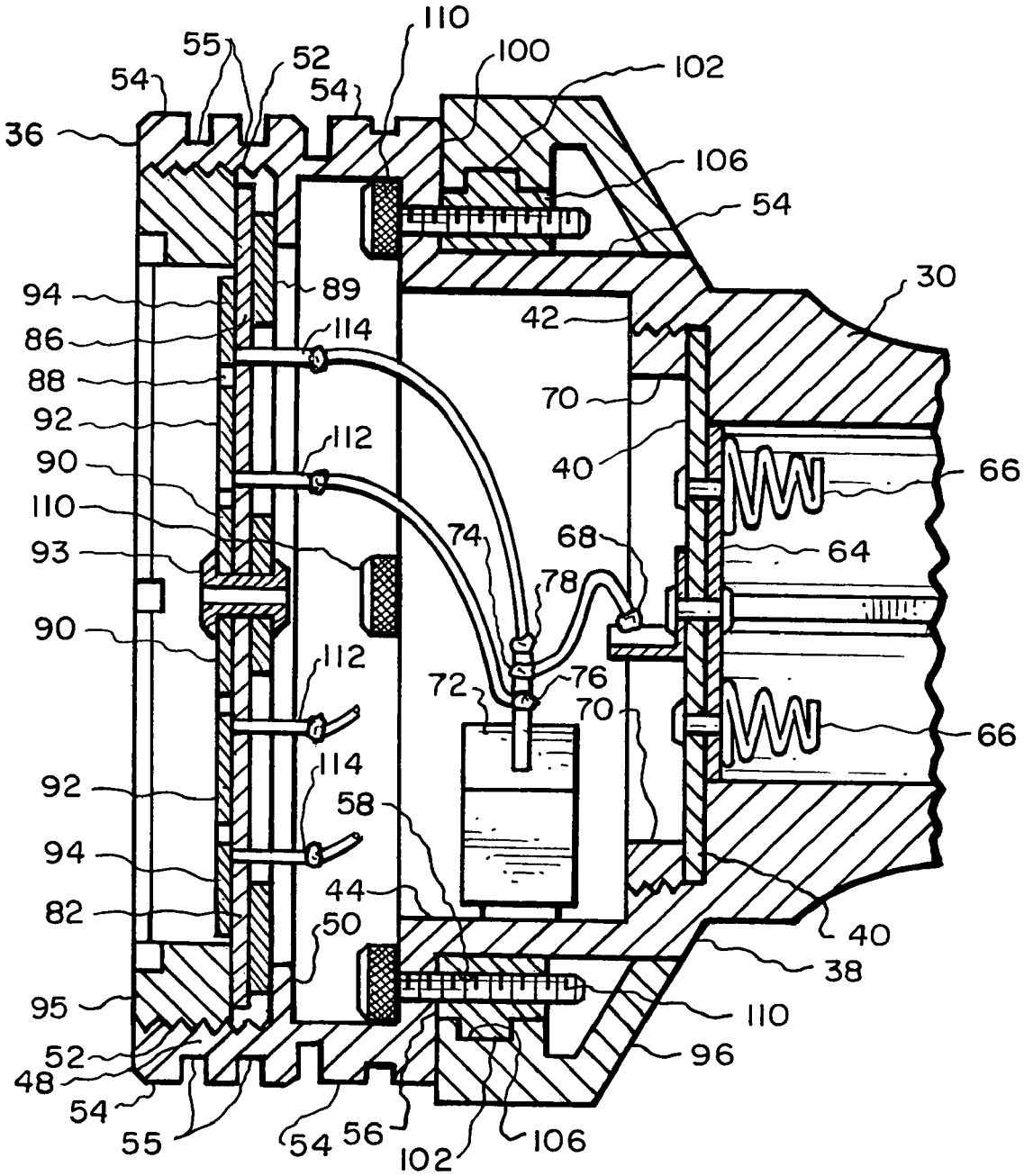
FIG. 7 is a side sectional view of the searchlight body of FIG. 6 taken along the line 7-7 in the direction of the appended arrows.

With reference to FIGS. 4, 6, and 7, a round, flat, rigid, electrically insulating PC board 64 is disposed in the PC board housing portion 38 and supports a rearward-biased, rearward-protruding metal PC board spring assembly 66 for securing the battery module 35 within the middle portion 34 of the searchlight body 30 and for establishing electrical continuity with the forward terminal of the battery module 35. The PC board 64 also supports a forward-facing PC board contact 68 electrically connected to the PC board spring assembly 66. An externally threaded PC board retainer ring 70 is engaged with the PC board retainer engaging threads 42 and secures the PC board 64 against the PC board seating surface 40.

With reference to FIGS. 2, 6, and 7, identical first and second switches 72 each having a switch toggle 73 are secured onto the switch mounting portions 46 (the sectional view of FIG. 7 includes only one switch 72). The switches 72 are so oriented that each switch toggle 73 protrudes laterally from the external surface of the switch housing portion 44 and is mechanically displaceable in a plane perpendicular to the longitudinal axis of the searchlight body 30. Each switch 72 has a center input terminal 74, a low-intensity circuit terminal 76, and a high-intensity circuit terminal 78. Each switch 72, oriented as set forth above, is mechanically displaceable between a counterclockwise position (closing an electrical circuit from the center input terminal 74 to the low-intensity circuit terminal 76), a clockwise position (closing an electrical circuit from the center input terminal 74 to the high-intensity circuit terminal 78), and an intermediate position (opening both circuits). The PC board contact 68 is wired to the center input terminals 74 of both switches 72.

Figure 8:
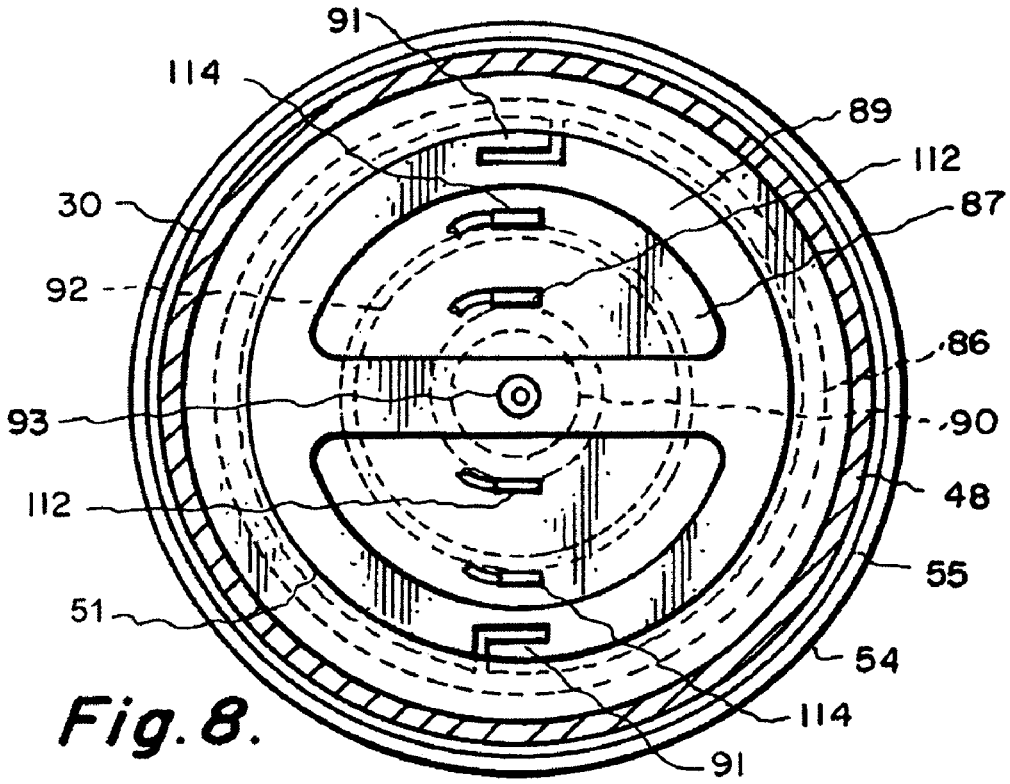
FIG. 8 is a rear sectional view of the body of FIG. 2 taken along the line 8-8 in the direction of the appended arrows.

With reference to FIGS. 2, 7, 8, and 9, a round, flat, rigid, electrically insulating mounting board 86 is disposed in the mounting board housing portion 48. With particular reference to FIG. 8, a rear sectional view of the body of FIG. 2 taken along the line 8-8 in the direction of the appended arrows, there are shown the mounting board housing portion outer surfaces 54, the mounting board housing portion 48 (shaded for metal), and the mounting board seating portion 51. Disposed inside the mounting board housing portion 48 and immediately forward of the mounting board seating portion 51 is the mounting board 86, whose periphery is drawn in phantom because the mounting board seating portion 51 blocks direct view of it from the rear. Also shown is the mounting board rear surface 87 on which is disposed a metallic mounting board ground contact plate 89 having two diametrically opposite, rearward-protruding, rearward-biased elastic electric contacts 91. The outer portions of the contacts 91 and of the mounting board ground contact plate 89 are drawn in phantom because the mounting board seating portion 51 blocks direct view of them from the rear. A mounting board central conductor 93 is electrically connected to the mounting board ground contact 89 and extends forward through the mounting board 86. Also shown are the two mounting board intermediate conductors 112 and the two mounting board outer conductors 114.

Figure 9:
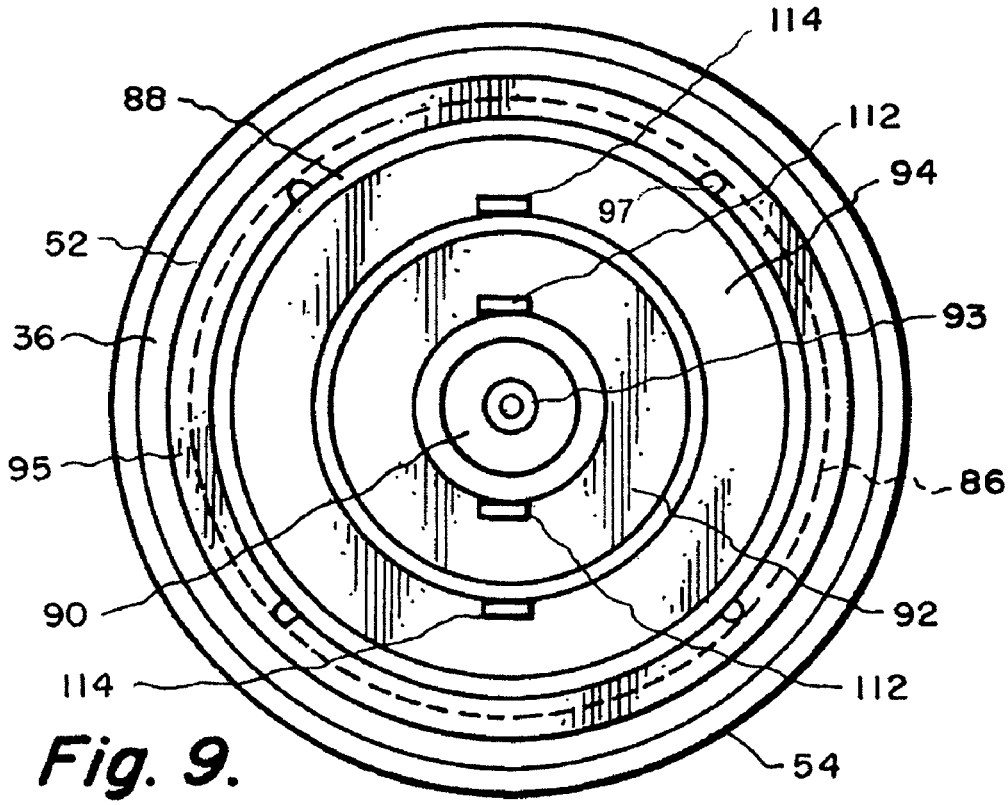
FIG. 9 is a front sectional view of the body of FIG. 2 taken along the line 9-9 in the direction of the appended arrows.

With particular reference to FIG. 9, a front sectional view of the body of FIG. 2 taken along the line 9-9 in the direction of the appended arrows, there are shown the mounting board housing portion 48, the front end 36, and a circular, externally threaded retaining ring 95, which has four key-engagement recesses 97 for removal and disassembly. The mounting board 86 (whose periphery is drawn in phantom because the retaining ring 95 blocks direct view of it from the front) has a flat, forward-facing mounting board front surface 88 on which are disposed a central contact plate 90 and, concentrically thereabout, electrically discrete and radially spaced apart intermediate contact ring 92 and outer contact ring 94. The central contact plate 90 is electrically connected to the mounting board central conductor 93. The intermediate contact ring 92 is electrically connected to two mounting board intermediate conductors 112, which project rearward through the mounting board 86 to the mounting board rear surface 87, where they are wired to the low-intensity circuit terminals 76 of both switches 72. The outer contact ring 94 is electrically connected to two mounting board outer conductors 114, which project rearward through the mounting board 86 to the mounting board rear surface 87, where they are wired to the high-intensity circuit terminals 78 of both switches 72. It will be understood that a lamp portion (shown generally at 37 in FIG. 1) is provided with electrical contacts (not shown) disposed at radii appropriate for establishing electrical continuity with the central contact plate 90, the intermediate contact ring 92, and the outer contact ring 94 when the lamp portion 37 is threadedly mounted on the front end 36 of the searchlight body 30.

With reference to FIGS. 4, 6, and 7, an actuator ring 96 is rotatably disposed about the searchlight body 30 immediately rearward of the mounting board housing portion outer surface 54. The actuator ring 96 has a grip-textured outer ring surface 98, a forward-facing circular ring sliding surface 100, an interior race 102, two diametrically opposite pairs of circumferentially spaced apart deformable toggle-engaging cushions 104 (best seen in FIG. 6), and two stops 105. The circular ring sliding surface 100 abuts the actuator guide seating surface 56. Each pair of toggle-engaging cushions 104 embraces one switch toggle 73. Within the race 102 are slidably disposed two lubricated arcuate actuator guides 106, each defining two longitudinal bolt bores 108. Each bolt bore 108 is aligned with an actuator guide retainer bore 58. Four bolts 110, inserted from the front end 36 rearward, secure the two actuator guides 106 against the actuator guide seating surface 56, thereby securing the actuator ring 96 in sliding rotatable proximity to the actuator guide seating surface 56. It will be appreciated that, as the actuator ring 96 is rotated relative to the searchlight body 30, one cushion 104 of each pair of cushions 104 will encounter each switch toggle 73. As the two switch toggles 73 approach the limits of their displacement, they will resist further rotation. However, before these limits of displacement are exceeded in either direction, one of the two stops 105 on the actuator ring 96 will interfere with further rotation of one of the actuator guides 106. This protects the switch toggles 73 from being forced beyond the limits of their displacement.

Figure 10:
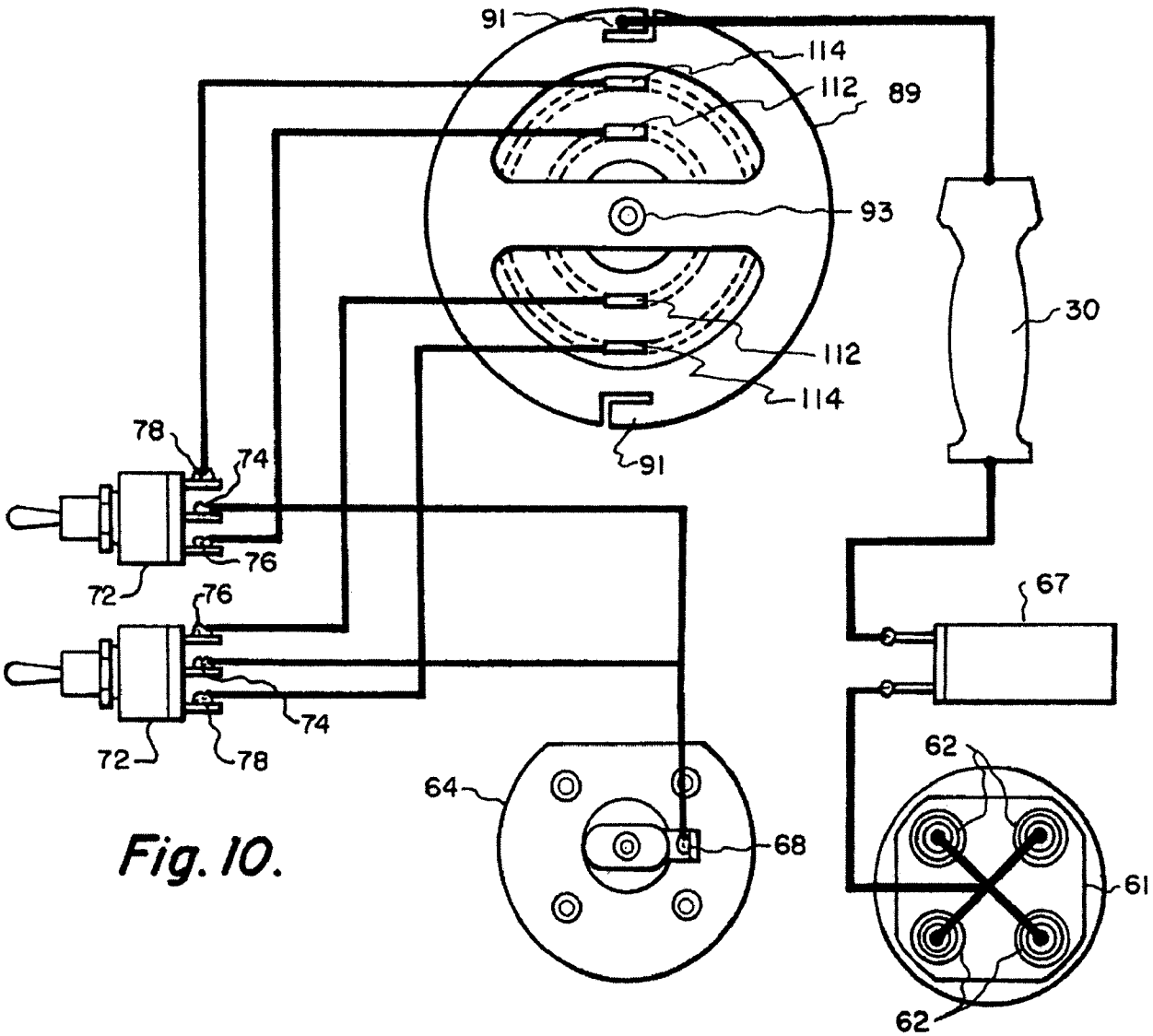
FIG. 10 is a schematic depiction of the electrical interrelations of the switches, current limiter, and searchlight body in accordance with the present invention.

With reference to FIG. 10, the electrical circuit is established from a positive terminal (not shown) of a battery module (not shown) through the following elements in series: PC board spring assembly 66; PC board contact 68; center input terminals 74 of both switches 72 in parallel; both switches 72 in parallel. Serially, the next element in the circuit depends on the states of the switches 72. Thus, the circuit may be open if both switches are in an OFF state, in which case current will not flow. If the switches 72 are in the state corresponding to low-intensity illumination, the next element in the circuit is both low-intensity circuit terminals 76 in parallel. If the switches 72 are in the state corresponding to high-intensity illumination, the next element in the circuit is both high-intensity circuit terminals 78 in parallel. The states of the switches depend on the position of the actuator ring 96 (this position is not represented in FIG. 10).

With continued reference to FIG. 10, the next element in the circuit, again depending on the states of the switches 72, is one, the other, or neither of the outer contact ring 94 and the intermediate contact ring 92; followed by one, the other, or neither of the low-intensity and high-intensity circuits of the lamp portion 37 (the lamp portion 37 is shown generally in FIG. 1).

With continued reference to FIG. 10, the low-intensity and high-intensity circuits of the lamp portion 37 (the lamp portion 37 is shown generally in FIG. 1) are grounded via the central contact plate 90, which is electrically connected to the mounting board central conductor 93, which extends rearward through the mounting board 86 and is electrically connected to the mounting board ground contact 89 on the mounting board rear surface 87. The mounting board ground contact 89 is peripherally cut and bent to provide two rearward-protruding, rearward-biased elastic electric contacts 91, which make electrical contact with the bare metal mounting board seating surface 50 (see FIGS. 7 and 8) of the mounting board housing portion 48 of the metal searchlight body 30. As shown schematically in FIG. 10 and with greater detail in FIGS. 2, 3, and 11, the searchlight body completes a ground path via the metal tail cap 60; the current limiter contact 69; the current limiter block 65 and current limiter 67; and the tail cap springs 62; and finally, to a negative terminal of a battery module 35 located inside the middle portion 34 of the searchlight body 30.

With reference to FIGS. 2 and 6, in the assembled searchlight, responsive to externally applied torque, the actuator ring 96 displaces the pairs of cushions 104, which urge both switch toggles 73 simultaneously from one to another of the above-described low-intensity, off, and high-intensity positions. Because the cushions 104 are deformable, they reduce the exposure of the switch toggles 73 to overtravel when the actuator ring 96 is operated forcibly. Additional protection against overtravel of the toggles 73 results from the fact that the actuator guides 106 and the race 102 cooperate to limit the range of rotation of the actuator ring 96.

With reference to FIGS. 1 and 4, the actuator ring 96 is relatively large and has a grip-textured outer ring surface 98. Thus, the actuator ring 96 is easily reached, felt, and operated by a person whose attention must be focused elsewhere or whose hands are gloved, slippery, weak, or numb. Being symmetrical, the actuator ring 96 is reached, felt, and operated the same way from all sides of the searchlight.

The switches 72 are chosen for their simplicity and for proven performance and durability, rather than for any shape or configuration specially adapted to searchlights. Thus, they may be selected with reference to familiar military or industrial specifications and purchased at low cost from established sources.

With reference to FIGS. 6 and 10, cooperation between the actuator ring 96 and the two parallel-wired switches 72 endows the searchlight with redundancy in the event that one of the switches 72 fails or becomes disconnected, while providing a simple hand-operable part for operating both switches 72. The switches 72 are also located on opposite sides of the searchlight body 30, reducing the likelihood that a local intrusion or impingement damaging or disconnecting one of the switches 72 would affect the other.

Figure 12:
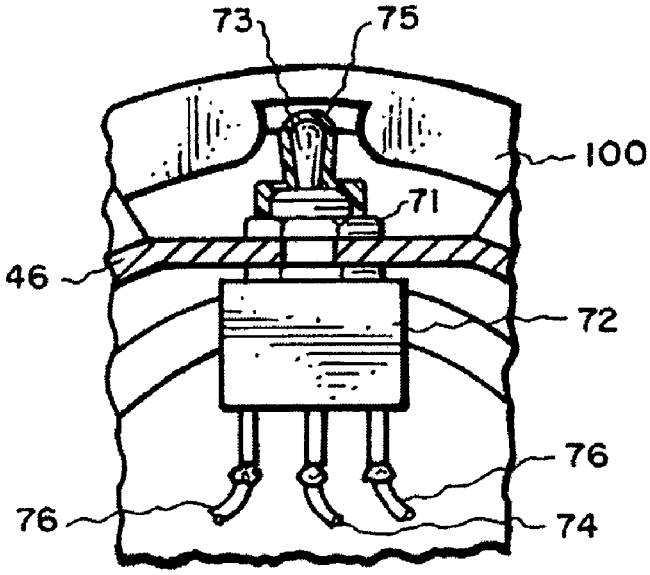
FIG. 12 is a portion of the side view of FIG. 6 showing an alternative embodiment incorporating a boot over a switch toggle.

FIG. 12 shows an alternative embodiment of the present invention in which an elastomeric boot 75 encapsulates the toggle 73 of the switch 72. In this alternative embodiment, the elastomeric boot 75 provides protection from overtravel. As a result, the cushions 104 may either remain part of the invention as otherwise disclosed herein, or be replaced by similar-shaped structure lacking deformability—for example, the actuator ring 96 may be shaped to engage the toggle 73 via the boot 75, but may be formed as a single piece of sturdy material without the added expense of separately providing and attaching the cushions 104. Also in this alternative embodiment, the boot forms a barrier against the intrusion of moisture into the switch 72.

While the foregoing detailed description has described several embodiments of a searchlight switch actuator in accordance with the present invention, it is to be understood that the above description is illustrative only and not limiting of the disclosed invention. Indeed, it will be appreciated that the embodiments discussed above and the virtually infinite embodiments that are not mentioned could easily be within the scope and spirit of the present invention. Thus, the present invention is to be limited only by the claims as set forth below.

What is claimed is:

1. A searchlight, comprising:

a searchlight body;

a searchlight lamp portion operatively connected to said body and having a plurality of operative states;

at least two switches disposed on said searchlight and being adjustable among a plurality of switch conditions corresponding to said operative states, each of said at least two switches including a toggle; and a toggle-engaging actuator disposed about said searchlight and being displaceable thereabout among a plurality of actuator positions, said actuator positions corresponding to said switch conditions.

2. A searchlight as set forth in claim 1, wherein said actuator is disposed about said body.

3. A searchlight as set forth in claim 1, wherein said actuator is rotatably disposed on said searchlight.

4. A searchlight as set forth in claim 1, wherein said actuator encircles said searchlight.

5. A searchlight as set forth in claim 1, wherein said actuator includes a grip-textured surface.

6. A searchlight as set forth in claim 1, wherein said actuator mechanically engages said toggle of each of said at least two switches.

7. A searchlight as set forth in claim 6, including a cushion operatively disposed between said actuator and said toggle.

8. A searchlight as set forth in claim 7, wherein said cushion is incorporated into said actuator.

9. A searchlight as set forth in claim 7, wherein said cushion is disposed about said toggle.

10. A searchlight as set forth in claim 1, wherein said actuator includes a race, said race includes an actuator guide, and said actuator guide is fixed relative to said searchlight body and movably confined within said race.

11. A searchlight as set forth in claim 1, wherein a boot encases said toggle.

12. A searchlight as set forth in claim 1, wherein the toggles of said at least two switches redundantly engage said actuator.

13. A searchlight as set forth in claim 1, wherein said at least two switches redundantly establish correspondence between said actuator positions and said operative states.

14. A searchlight as set forth in claim 1, wherein said actuator encircles said searchlight and is circumferentially rotatable relative to said searchlight, and the toggles of said at least two switches engage said actuator at circumferentially different locations on said actuator.

15. A searchlight as set forth in claim 1, including a current limiter electrically connected to limit current to said lamp portion.

16. A searchlight as set forth in claim 1, including a tail cap operatively disposed on said body, said tail cap including a current limiter.

17. A searchlight as set forth in claim 16, wherein said tail cap is replaceably removable from said searchlight body and said current limiter is replaceably removable from said tail cap.

18. A searchlight as set forth in claim 16, said tail cap including a compartment and an openable closure covering said compartment, said current limiter being contained within said compartment.

19. A searchlight as set forth in claim 16, wherein said current limiter is selected from the set including: a fuse and a circuit breaker.

20. A searchlight, comprising:

a searchlight body;

a searchlight lamp portion operatively connected to said body;

a tail cap, disposed on said body, replaceably removable from said body, and containing a current limiter block; and a current limiter disposed in said current limiter block, said current limiter being electrically connectable to limit current delivered to said lamp portion and being replaceably removable from said current limiter block.

21. A portable searchlight body, adapted to be coupled to a lamp portion having a plurality of operative states, the searchlight body comprising:

at least two switches disposed on said searchlight body and being adjustable among a plurality of switch conditions, each of said switch conditions corresponding to an operative state of said lamp portion, each of said at least two switches including a toggle; and a toggle-engaging actuator ring disposed about said searchlight body and being displaceable thereabout among a plurality of actuator positions, said actuator positions corresponding to said switch conditions.

22. A searchlight as set forth in claim 21, wherein said actuator includes a race, said race includes an actuator guide, and said actuator guide is fixed relative to said searchlight body and movably confined within said race.

23. An actuating mechanism for a searchlight having a plurality of illuminative states, the actuating mechanism comprising:

at least two switches disposed on said searchlight and being adjustable among a plurality of switch conditions corresponding to said illuminative states, each of said at least two switches including a toggle; and a toggle-engaging actuator ring disposed about said searchlight and being rotatable thereabout among a plurality of actuator positions corresponding to said switch conditions.

24. An actuating mechanism as set forth in claim 23, wherein said actuator ring has a grip-textured surface.

25. An actuating mechanism as set forth in claim 23, wherein said at least two switches have a plurality of switch positions corresponding to said switch conditions, said actuator ring mechanically engaging the toggles of said at least two switches, and displacement of said actuator ring among said actuator positions displaces said toggles among said switch positions.

26. An actuating mechanism as set forth in claim 25, including a cushion operatively disposed between said actuator and each of said toggles.

27. An actuating mechanism as set forth in claim 25, wherein said actuator includes a cushion.

28. An actuating mechanism as set forth in claim 26, including a cushion disposed on each of said at least two switches.

29. An actuating mechanism as set forth in claim 23, wherein said actuator includes a race, said race includes an actuator guide, and said actuator guide is fixed relative to said searchlight and movably confined within said race.

30. An actuating mechanism as set forth in claim 23, including a boot disposed on said toggle.

31. An actuating mechanism as set forth in claim 23, wherein said at least two switches redundantly establish correspondence between said actuator positions and said illuminative states.

32. An actuating mechanism as set forth in claim 23, wherein said actuator encircles said searchlight and is circumferentially rotatable relative to said searchlight, and the toggles of said at least two switches engage said actuator at circumferentially different locations on said actuator.

33. An actuating mechanism as set forth in claim 23, including a tail cap operatively disposed on said body, said tail cap including a current limiter.

34. An actuating mechanism as set forth in claim 33, said tail cap including a compartment and an openable closure covering said compartment, said current limiter being contained within said compartment.

35. An actuating mechanism as set forth in claim 33, wherein said current limiter is selected from the set including: a fuse and a circuit breaker.

36. A searchlight, comprising:

a searchlight body;

a searchlight lamp portion operatively connected to said body and having a plurality of operative states;

at least two switches disposed on said searchlight and being adjustable among a plurality of switch conditions corresponding to said operative states; and a switch-engaging actuator disposed about said searchlight and being displaceable thereabout among a plurality of actuator positions, said actuator positions corresponding to said switch conditions;

a tail cap operatively disposed on said body; and a current limiter in said tail cap, said current limiter selected from the set including: a fuse and a circuit breaker.

37. An actuating mechanism for a searchlight having a plurality of operative states, the actuating mechanism comprising:

at least two switches disposed on said searchlight and being adjustable among a plurality of switch conditions corresponding to said operative states;

a switch-engaging actuator ring disposed about said searchlight and being rotatable thereabout among a plurality of actuator positions corresponding to said switch conditions; and a tail cap operatively disposed on said body, said tail cap including a compartment, an openable closure covering said compartment, and a current limiter contained with said compartment.

38. In a flashlight, the combination comprising:

a flashlight body;

a battery in said body;

a flashlight lamp portion having a plurality of operative states;

at least two switches in circuit with said battery and said lamp portion, said at least two switches adjustable among a plurality of switch conditions corresponding to said operative states;

a switch actuator disposed on said flashlight body and coupled to said at least two switches, said switch actuator displaceable among a plurality of actuator positions corresponding to said switch conditions; and a current limiter connected in said circuit.

39. A flashlight as set forth in claim 38, wherein said switch actuator is rotatably displaceable about said body.

40. A flashlight as set forth in claim 39, wherein said switch actuator comprises a ring encircling said body.

41. A flashlight as set forth in claim 38, wherein said current limiter is selected from the set including: a fuse and a circuit breaker.

42. A flashlight as set forth in claim 38, including a tail cap removably connected to said body, and wherein said current limiter is disposed in said tail cap.

43. A flashlight as set forth in claim 38, wherein said current limiter is removably connected in said circuit.

44. In a flashlight, the combination comprising:

a flashlight body;

a battery in said body;

a flashlight lamp portion;

a switch;

a current limiter; and a circuit electrically coupling said battery, said lamp portion, said switch and said current limiter for controlling illumination of said lamp portion, said current limiter removably connected in said circuit.

45. A flashlight as set forth in claim 44, wherein:

said current limiter is selected from the set including: a fuse and a circuit breaker.

46. A flashlight as set forth in claim 44, including a tail cap removably attached to said body, and wherein said current limiter is disposed to said tail cap.

47. In a flashlight, the combination comprising:

a flashlight body;

a battery in said body;

a flashlight lamp portion;

a tail cap removably fastened to said body;

a current limiter block in said tail cap;

a current limiter disposed in said current limiter block; and a circuit electrically coupling said battery, said lamp portion, said switch and said current limiter block for controllably illuminating said lamp portion.

48. The flashlight according to claim 47, wherein said current limiter is removably disposed in said current limiter block.

49. A flashlight as set forth in claim 47, wherein said current limiter is selected from the set including: a fuse and a circuit breaker.

50. An actuating mechanism for a searchlight having a plurality of operative states, the actuating mechanism comprising:

at least two switches disposed on said searchlight and being adjustable among a plurality of switch conditions corresponding to said operative states;

a switch-engaging actuator ring disposed about said searchlight and being rotatable thereabout among a plurality of actuator positions corresponding to said switch conditions; and a tail cap operatively disposed on said body, said tail cap including a current limiter selected from the set including: a fuse and a circuit breaker.

51. A searchlight, comprising:

a searchlight body;

a searchlight lamp portion operatively connected to said body and having a plurality of operative states;

at least two switches disposed on said searchlight and being adjustable among a plurality of switch conditions corresponding to said operative states; and a switch-engaging actuator disposed about said searchlight and being displaceable thereabout among a plurality of actuator positions, said actuator positions corresponding to said switch conditions;

a tail cap operatively disposed on said body and including a compartment and an openable closure covering said compartment; and a current limiter contained within said compartment.

52. A searchlight, comprising:

a searchlight body;

a searchlight lamp portion operatively connected to said body and having a plurality of operative states;

at least two switches disposed on said searchlight and being adjustable among a plurality of switch conditions corresponding to said operative states;

a switch-engaging actuator disposed about said searchlight and being displaceable thereabout among a plurality of actuator positions, said actuator positions corresponding to said switch conditions;

a tail cap operatively disposed on said body and replaceably removable therefrom; and a current limiter in said tail cap and replaceably removable therefrom.

53. In a flashlight, the combination comprising:

a flashlight body;

a battery in said body;

a flashlight lamp portion having a plurality of operative states;

at least two switches in circuit with said battery and said lamp portion, said at least two switches adjustable among a plurality of switch conditions corresponding to said operative states;

a switch actuator disposed on said flashlight body and coupled to said at least two switches, said switch actuator displaceable among a plurality of actuator positions corresponding to said switch conditions;

a tail cap removably attached to said body; and a current limiter block in said tail cap and connected in said circuit.

54. A flashlight as set forth in claim 53, including a current limiter removably disposed in said current limiter block.

55. A flashlight as set forth in claim 54, wherein said current limiter is selected from a set including: a fuse and a circuit breaker.

56. In a flashlight, the combination comprising:

a flashlight body;

a battery in said body;

a flashlight lamp portion;

a switch;

a current limiter selected from the set including: a fuse and a circuit breaker; and a circuit electrically coupling said battery, said lamp portion, said switch and said current limiter for controlling illumination of said lamp portion.

57. In a flashlight, the combination comprising:

a flashlight body;

a battery in said body;

a flashlight lamp portion;

a switch;

a tail cap removably attached to said body;

a current limiter disposed to said tail cap; and a circuit electrically coupling said battery, said lamp portion, said switch and said current limiter for controlling illumination of said lamp portion.

58. A flashlight, comprising:

a flashlight body;

a flashlight lamp portion operatively connected to said body and having a plurality of operative states;

at least two switches disposed on said searchlight and being adjustable among a plurality of switch conditions corresponding to said operative states; and a switch-engaging actuator disposed about said flashlight and being displaceable thereabout among a plurality of actuator positions corresponding to said switch conditions for simultaneously adjusting said at least two switches to a selected one of said switch conditions.

59. A flashlight as set forth in claim 58, wherein said actuator is rotatably disposed about said body.

60. A flashlight as set forth in claim 58, wherein said actuator mechanically engages said at least two switches.

61. A flashlight as set forth in claim 58, wherein each of said at least two switches includes a toggle and said toggle engages said actuator.

62. A flashlight as set forth in claim 58, including a current limiter in circuit with said at least two switches, said battery and said lamp portion.

63. A flashlight as set forth in claim 62, wherein said current limiter is removably connected in said circuit.

64. A flashlight as set forth in claim 62, wherein said current limiter is selected from the set including: a fuse and a circuit breaker.

* * * * *